United States Patent [19]

Bosch

[11] 4,109,490

[45] Aug. 29, 1978

[54] SLIDING LATCH NEEDLE

[75] Inventor: Juan Bosch, Mataro, Spain

[73] Assignee: Tecnologia Industrial, Proyectos Y Promociones, S.A., Mataro, Spain

[21] Appl. No.: 774,605

[22] Filed: Mar. 4, 1977

[30] Foreign Application Priority Data

Mar. 5; 1976 [ES] Spain ..... 445.984

[51] Int. Cl.[2] ..... D04B 35/06

[52] U.S. Cl. ..... 66/120

[58] Field of Search ..... 66/120, 123

[56] References Cited

U.S. PATENT DOCUMENTS

| | | | |
|---|---|---|---|
| 1,364,088 | 1/1921 | Fenn | 66/120 X |
| 1,475,182 | 11/1923 | Hanes | 66/120 X |
| 1,563,233 | 11/1925 | Scott | 66/120 X |
| 1,634,423 | 7/1927 | Hull | 66/13 |
| 1,856,052 | 4/1932 | Gagne | 66/120 |
| 2,522,335 | 9/1950 | Amidon | 66/120 X |
| 3,229,485 | 1/1966 | Peschl et al. | 66/120 |
| 3,584,481 | 6/1971 | Hayashi | 66/120 |
| 3,828,582 | 8/1974 | Widdowson et al. | 66/120 X |
| 4,043,153 | 8/1977 | Lindner et al. | 66/120 |

FOREIGN PATENT DOCUMENTS

| | | | |
|---|---|---|---|
| 1,283,027 | 7/1972 | United Kingdom | 66/120 |

*Primary Examiner*—Werner H. Schroeder
*Assistant Examiner*—Andrew M. Falik
*Attorney, Agent, or Firm*—Haseltine, Lake & Waters

[57] ABSTRACT

A needle assembly for use in a knitting machine, particularly circular and flat knitting machines having one or more working systems and one or two working needle beds, the needle comprising a casing body of elongated rectangular form with a groove in its upper two-thirds portion, the head of the needle forming a hook for picking up the thread and the body having a cross-section of elongated U-shape at the groove. In the interior of the groove there is slidably arranged a plate likewise of rectangular and elongated form and provided with a lug projecting laterally from the body of the needle. The needle is provided at its lower portion with a lug for co-operation in the course of its passage on the cams of the working system of the machine during its needle raising and lowering action, the plate likewise co-operating by its lug with positioning stops of the working system of the machine in respect of the opening and closing, as necessary, of the hook of the needle. The stroke of the plate is limited by travel end stops of elongated form disposed in the mouth of the grooved recess of the needle body at upper and lower parts of the mouth, defining a free path for the sliding of the lug of the plate.

10 Claims, 8 Drawing Figures

SLIDING LATCH NEEDLE

FIELD OF THE INVENTION

The present invention relates to improvements in knitting machines and particularly a device comprising a special needle with a sliding plate incorporated in the needle itself, and a cam system or box for operating said special needle, which can be fitted both on circular and flat knitting machines having one or more working systems and one or two needle beds or needle-holding means, of the types known as single jersey and double jersey, for producing plain, interlock, 8-lock and jacquard knitted fabrics.

BACKGROUND

As is known, at the present time there are two types of needles for knitting on circular knitting machines and these are known as spring beard and latch needles, respectively. The first-mentioned needles are fitted on circular knitting machines having a single needle bed or needle-holding means and, for their knitting action, the needles must be assisted by pressers which act on the hooks of the needles in order to close them and be able to cast off the loop from the previous picking-up operation across the thread retained in the hook closed by the pressure of the presser. Latch needles have attachments, called latches, which close the hooks of the needles as a result of the pressure exerted by the loop from the picking-up operation prior to a given stitch forming operation and located below the latch, in order to cast this loop off across the thread retained in the hook of the needle and it is this thread which will open the latch in the direction opposite to the previous direction, so that the said thread or already formed loop may pass behind the latch, the latter having to remain open until the thread is picked up again, this being the most common method for forming knitted fabric in flat and circular machines having one or two needle beds.

This method of knitting with needles having a radially articulated latch has certain disadvantages in flat and circular knitting machines, such as the need for great precision of adjustment of the yarn guides associated with the needles, these guides being required to cover perfectly over their width the path described by the needles during their knitting process and to protect the latches, leaving a free space for them to open and close. Maladjustment of the yarn guides may cause the latches to strike against the edges of the yarn guides as they open and break, or else close before the yarn or thread is picked up. For higher machine working speeds, there is risk of rebounding and rubbing of the latches against the yarn guides, and damage of the latches, which leads to defects in the knitted fabrics produced.

Another disadvantage when the machine has greater working speeds is that the radially articulated latches of the needles close with much more force, striking sharply against the hook of the needle and causing it or the tongue itself to break, especially when the operation is performed with very fine needles in machines of fine gauge or with many needles per inch.

Apart from these mentioned disadvantages of mechanical type, others arise due to the operation itself of knitting machines knitting with needles having a radially articulated latch, such as the release of loops, or dropped stitches, due to the fact that when a loop is cast off in a stitch forming operation, it passes across the latch, closing it abruptly and causing it to rebound, which leaves it open, the loop being simply picked up by the hook of the needle. If the loop is very long, it is loose within the hook of the needle and if the tension of the fabric produced by the machine is low, the loop may disengage itself from the hook of the needles, causing a fault known as "dropped stitches" in the fabric.

In the method hereinbefore mentioned for knitting in flat and circular knitting machines, the thread or formed loop in the hook of the needle with a radially articulated latch which produces the mechanical force for opening and closing the articulated latch of the needle has proved to be a drawback. The thread is subjected to a constant stress, since while the thread is picked up by the head or hook of the needle, the previous loop formed behind the latch compels it, by forcing it, to close over the picked-up thread, and this, as it rubs against the tongue, gives rise to separation of the fibers and, at the same time, the danger of the thread being cut, due to the fact that as the latch closes, pressed by the loop, it exerts a scissors action, consequently producing a fault in knitted fabrics of synthetic and continuous yarns which is of the kind called "fiber separation" or "nap" giving rise to fabric with cut loops.

In the case of the beard needle without a latch and assisted by a presser, apart from the fact that it cannot be operated in machines having two needle beds, there is also the disadvantage that due to the action of the presser, the hook of the needle is subjected to a constant bending stress and can break through fatigue.

SUMMARY OF THE INVENTION

The invention is based on improving the knitting process in flat and circular knitting machines having one or more working systems and one or two needle beds in order to obtain a fabric which can be made up with any kind of synthetic or natural fibers, however delicate they may be, by avoiding the disadvantages hereinbefore mentioned, and by offering smooth knitting action without compelling the knitting loop to exert knitting forces.

According to the invention, improvements in knitting machines are achieved by improving the mechanism of the needles so as to avoid the disadvantages of the conventional machines.

The needle according to the present invention is completely different, in form and operation, from the conventional needles hereinbefore described, there being moreover obtained as an improvement in knitting machines, by the application of this new needle, the advantage of a greater working speed in relation to that which can be achieved in present machines having needles with an articulated latch.

The above-mentioned disadvantages are eliminated, by virtue of the improvements described herein, due to the fact that all of the needles which are employed in this novel method of knitting in flat and circular knitting machines having one or more working systems and one or two needle beds comprises at its upper portion a hook which facilitates the picking-up of the thread or yarn, and a guide plate disposed in a frontal groove formed in the needle and having a sliding movement therein, the needle and plate forming a single unit. The function of this plate is to leave the hook of the needle free for picking-up the thread and to close it for the castingoff operation in the formation of the loop of the knitted fabric.

For the sliding action of the plate in the needle, the plate has a lug projecting from the body of the needle and the latter, which is likewise provided with a lug at the bottom, co-operates on its passage by the cams of the working system of the machine, during its needle raising and lowering action, so that the plate acts by means of its lug to clear the hook of the needle or to close it. To this end, the needle itself has upper and lower travel stops or end stops for the sliding action of the plate, whereby when the plate reaches its lower position, the hook of the needle is open, and the same needle, through contact of its lower stop with the plate, raises it to the appropriate position on the passage of the needle by the cams of the working system of the machine.

When the needle descends in its passage by the cams of the working system of the mcahine, the sliding plate incorporated in the needle is held by means of its lug at the cam of the working system of the machine, maintaining the same level by contact of its lug with the cam. Meanwhile, the needle descends until its hook is closed by the plate through contact of the upper stop of the needle with the plate. At this instant, a stoppage occurs in the descending movement of the needle, releasing the lug of the plate with respect to the cam on which it has been resting and the same plate making contact with the upper stop of the needle. The needle, in its second descending movement, carries the plate along, the plate keeping the hook closed until the loop has been completely castoff over the plate and across the picked-up thread, thus forming the knitted loop.

During both opening and closing, the hook of the needle is free from shocks or impacts or bending, whereby its integrity or unbroken state is ensured, since the hook and the plate never come to the point of striking each other, and the necessity for the thread to be knitted to actuate the latch is obviated, this function now being assumed by the plate which replaces the latch. By the use of this novel needle in knitting machines, the drawback of meticulous adjustment of the yarn guides and of the protection of the needles along the path described by them in their knitting process is obviated, since the needles do not need mechanical yarn guides for their protection, but simply an eyelet as a guide for the yarn so that it may be picked up by the needle, all the disadvantages hereinbefore mentioned being thereby avoided.

The sliding-plate needle of the invention is composed, in the upper part, of a hook for picking-up the associated thread and a plate guided and inserted in a frontal groove formed in the needle itself, with a lug projecting from the body of the latter for its action as a slide for the plate, the path of the plate being limited by upper and lower travel stops or end stops which at the same time close the guide groove for the plate at the front part thereof, leaving a defining opening between the upper stop and the lower stop for the passage of the lug of the plate projecting from the body of the needle, the needle and plate thus forming a single unit.

The stem or shank of the needle is of elongated rectangular form and may have, in its lower part, one or more projections or lugs at given intervals, according as there are arranged, in the knitting machines, cam boxes having different heights of cam paths for the needles and for the selection of given needles in the working systems or cam boxes for the production of plain, interlock and 8-lock knitted fabrics. Alternatively, the needle itself with the sliding plate may be assisted for its working selection in the machine by a conventional or special jack for the purpose of producing knitted fabrics of the kind called jacquard pattern knitted fabrics.

The basis of the improvements in knitting machines which are described herein is the new method of knitting by means of the needle and sliding plate assisted by a cam box or at least one working system of the machine. The application of these cam baxes or working systems in the present invention and according to the type or characteristics of the knitting machines is as follows:

In knitting machines of flat type known per se, the needles having a sliding plate are inserted in the grooves of the plates or needle beds in a number defined according to the pitch of the gauge and, for their knitting process, they are assisted by the cam box, which provides the sliding movement of the needle and of the plate.

In knitting machines of circular type known per se, of the kind called single jersey or one needle-bed machines, the needles with sliding plates are inserted in the grooves of the cylinder or needle-bed of the machine and, for their knitting process, they are assisted by the cam box, in one or more boxes or working systems, disposed around the cylinder or needle bed of the machine and, during its rotation or that of the cylinder, according to how the machine is arranged, the cam box provides the sliding movement of the needle and the plate.

In knitting machines of circular type known per se, of the kind called double jersey or two needle-bed machines, that is with a cylinder and a dial, the needles with the sliding plates are inserted vertically in the grooves of the cylinder and horizontally in the grooves of the dial, cam boxes or working systems being provided in the cylinder and the dial and assisting the needles in their knitting process by providing the sliding movement of the needle and plate during the rotation of the machine.

By way of comparison, in order to characterize better the present improvements in knitting machines with the new method of knitting, their main advantages will be given hereafter:

While conventional needles having a radially articulated latch need the assistance of a yarn guide which protects the latches, allowing them to open and avoiding undue closing thereof, in the needle with a sliding plate described in the present invention, as an improvement in the method of knitting, the protective yarn guide is not needed, thus avoiding the disadvantages of maladjustments.

Conventional needles with a radially articulated latch have premature wear of the central pivot of the latch during its function of opening and closing the hook of the needle, as a result of which wear, the latch does not close frontally against the hook, thus producing faults in the fabrics, On the other hand, with the sliding-plate needle described herein, the plate always closes the hook of the needle frontally, due to the fact that it slides through the guide formed by the groove made in the needle itself, the plate being guided on its four sides and never leaving the bed of the needle, the needle and plate thus forming a single unit.

Whereas conventional needles having a radially articulated latch require, for their knitting action, that it is the thread to be knitted itself which performs the mechanical function of opening and closing the latch with respect to the hook of the needle, with the aforesaid detrimental feature of damaging the thread, separating the fibers thereof or cutting it, the needle according to the invention, on the other hand, with its sliding plate, does not require the action of the thread for its knitting function, its operation being controlled completely mechanical and without the risk of damaging the thread which is being knitted.

Whereas with conventional needles having a radially articulated latch there is the disadvantage of having to limit the speed of the knitting machines, due to the fact that when the latch of the needle strikes against its hook there is the danger of breakage of the hook and the latch of the needle, with the needle according to the invention with its sliding plate there is the guarantee of being able to give the knitting machines a greater working speed due to the fact that, during the action of opening and closing the hook of the needle, the plate does not strike against the needle hook, it being possible to control all the knitting movements of the needle perfectly without the risk of breaking the hooks or plates. Moreover, this new method of knitting according to the invention is characterized in knitting machines by the fact that its application does not require complicated mechanisms, but only the provision of specific cams in the corresponding cam boxes, both of the dial and of the cylinder, without any limitation of possibilities in the knitting process, and embraces the construction of all conventional knitted structures.

DETAILED DESCRIPTION

Figure 1:
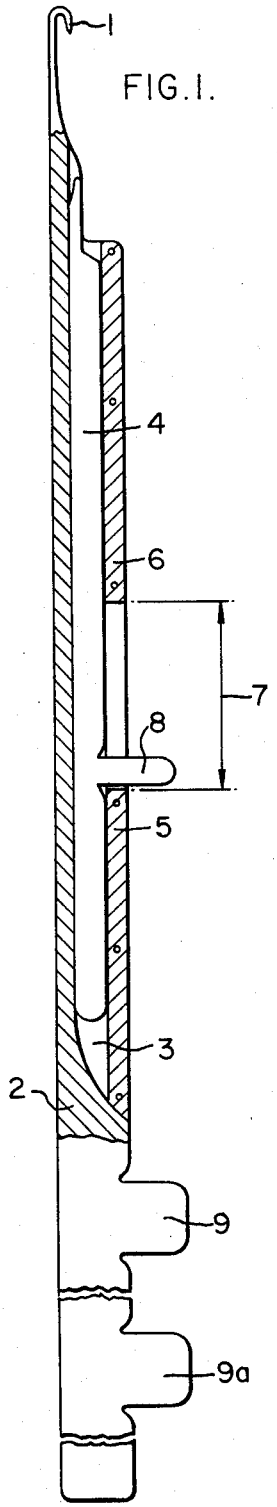
FIGS. 1 and 2 respectively show a needle according to the invention in longitudinal section with a plate therein in two limit positions.

Referring to the drawing, therein is seen a needle comprising a hook 1 for picking up the thread and a shank 2 of rectangular and elongated configuration. The shank 2 has a longitudinally extending lateral groove 3 therein extending about two-thirds of the length of the needle and housing a sliding plate 4, which is likewise rectangular and elongated. A lower stop 5 is mounted in the lateral groove 3 to establish the end of lower travel for the plate 4 and an upper stop 6 is mounted in the lateral groove 3 to establish the end of upper travel of plate 4. The extent of displacement of plate 4 is shown by numeral 7. A lug 8 on the plate 4 cooperates with the stops to establish the end of travel positions of the needle. The needle shank 2 has a lug 9 which may occupy different positions, such as that indicated in the middle part of the needle, to which there corresponds the path of complex form in the system of the machine, or the position indicated by the reference character **9*a* in the lower part of the needle, to which there corresponds a rectilinear path in the system of the machine. Numeral 10 designates a central longitudinal space in the needle in which the plate 4 moves in the interior of the needles. As seen in FIG. 2*a*, the shank has a generally U-shaped section along groove 3 and the stops 5 and 6 close the mouth of the groove 4 while leaving the clear space 7 for travel of lug 8**.

Figure 3:
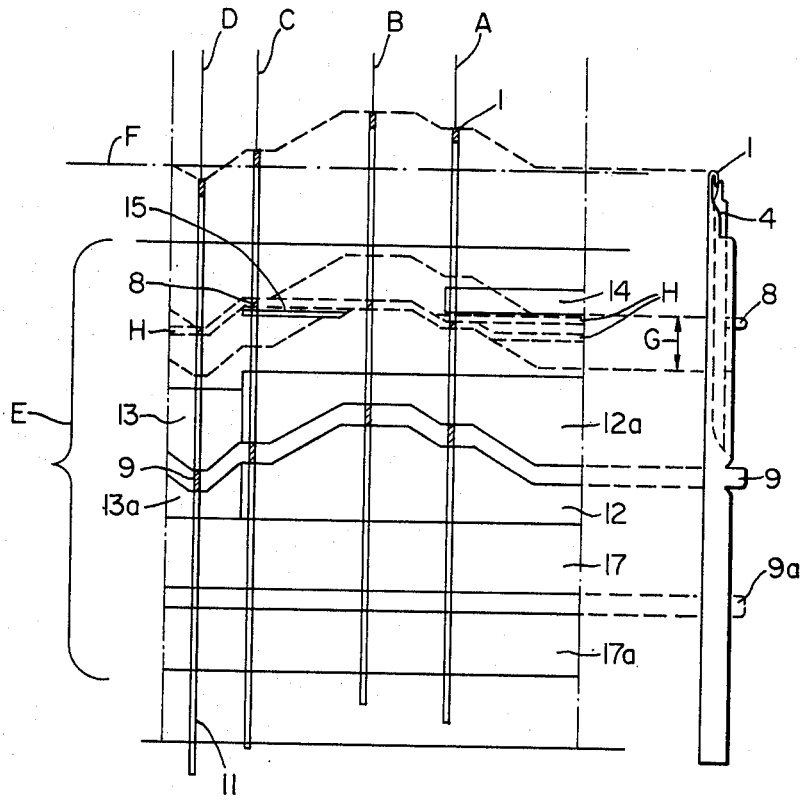
FIG. 3 is a diagrammatic illustration of the working system showing the positions of the needle during a knitting operation.
Figure 4D:
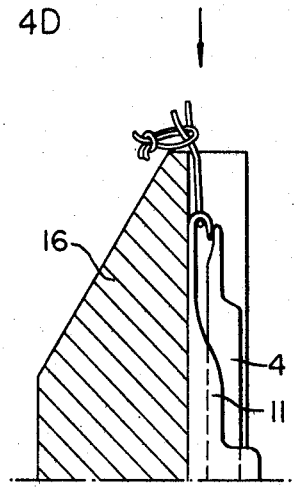
FIGS. 4A, 4B, 4C and 4D show four working stages of the needle and the sliding plate in the course of the working cycle of the machine for the complete formation of a loop in the knitted fabric.
Figure 4C:
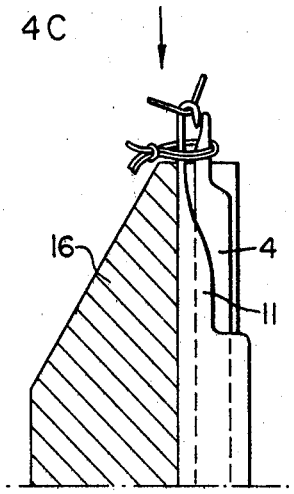
Figure 4B:
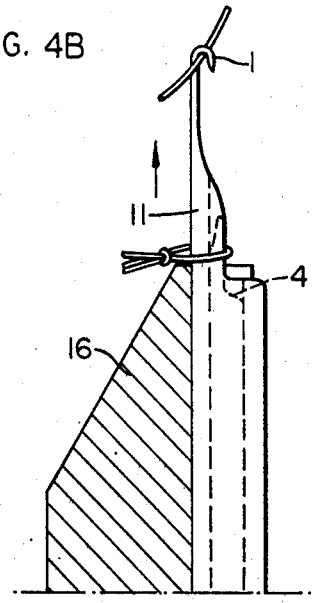
Figure 4A:
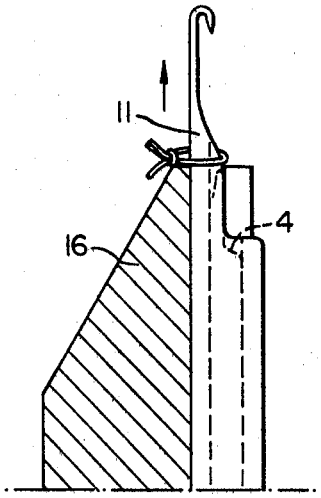

Numeral 11 in FIG. 3 shows the needle in the working position, numerals 12 and **12*a*, 13 and 13*a* designating cams of the working system of the machine. Numeral 14 shows a positioning stop and 15 a seating stop for cooperating with lug 8 whose path of travel is shown in dotted lines in FIG. 3. Numeral 16 designates a needle cylinder and 17 and 17*a*, lower cams defining the rectilinear path for the lug 9*a***.

The stops 5 and 6 are formed by rectilinear parts fitted at the edges of the internal grooved recess 3 of the body of the needle, and these stops can be affixed to these edges by soldering, riveting or the like.

Different positions of the needle during its operation are shown at A, B, C and D; E indicates all the functional operation of the machine in the working diagram. F is the upper edge of the needle cylinder of the machine. G indicates the travel of the lug 8 of the plate 4 corresponding to the travel extent 7 in FIGS. 1 and 2. H shows the path of the lug 8 of the plate 4 when the needle passes along the aforesaid cams 12 and 13.

Thus, the lug 9 cooperates with cams 12, **12*a*, 13, 13*a* for the sliding action of the needle during its ascending and descending travel with respect to the cams while transporting the plate 4 incorporated in the needle by contact of the lug 8 with the upper and lower stops of the needle itself, all this for the mechanical action of closing and opening the hook of the needle by means of the incorporated sliding plate. Additionally, the lateral lug 8 of the sliding plate 4 in the needle is displaced in its action of opening and closing the hook of the needle by the stops 5, 6 limiting its sliding travel and it is assisted by the cam systems for the operative working of the machine, said cam systems having respective cam paths for the ascending and descending functions of the needles, and the cam path defined by the positioning stops 14, 15** in the upper part of the system, for the actuation of the plates for opening and closing of the hooks of the needles.

Each needle and its plate forms an inseparable unit with coupled operation.

Figure 2:
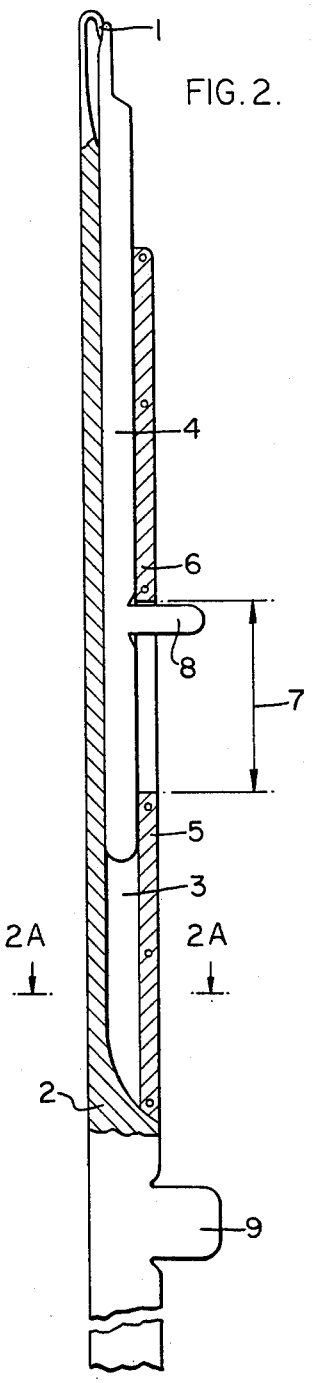
Figure 2A:
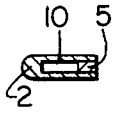
FIG. 2A is a section taken along line 2A—2A in FIG. 2.

From the above, it is seen that the invention provides a needle assembly for use in a knitting machine which comprises shank 2 having one end with hook 1 thereat, said shank having longitudinal groove 3 therein with slidable plate 4 mounted in the groove for movement between the extended position in which the plate cooperates with the hook as shown in FIG. 2 to close the hook and a retracted position as shown in FIG. 1 in which the hook is open. The lug 9 on the shank serves as a means for cooperating with the external cams for displacing the needle longitudinally between raised and lowered positions and the lug 8 projecting from the slide plate 4 serves as part of a stop means between the plate and the shank for establishing the retracted and extended positions of the plate while also cooperating with the external cams for extending and retracting the plate. The stop means further comprises the stop members 5 and 6 disposed at the mouth of groove 4 in longitudinally spaced relation to provide sliding travel 7 for lug 8.

Although the invention has been described in conjunction with a specific embodiment thereof, it will become apparent to those skilled in the art that numerous modifications and variations can be made within the spirit and scope of the invention as defined in the attached claims.

What is claimed is:

1. A needle assembly for use in a knitting machine comprising a shank having one end with a hook thereat, said shank having a longitudinal groove therein, a plate slidably mounted in said groove to form a single unit with said shank, said plate being slidably mounted for movement between an extended position in which the plate cooperates with said hook to close the same and a retracted position in which the hook is open, means on said shank for cooperating with external cams for displacing the shank longitudinally between raised and lowered positions, and stop means forming part of said unit and disposed cooperatively between said plate and said shank for establishing said retracted and extended positions of said plate while retaining said plate in said groove to preserve the integrity of said unit, said stop means comprising stop members bounding said groove in longitudinally spaced relation, and a lug on said plate positioned to contact said stop members respectively in said extended and retracted positions and to slide freely therebetween.

2. A needle assembly as claimed in claim 1 wherein said shank includes a U-shaped portion with said longitudinal groove therein.

3. A needle assembly as claimed in claim 1 wherein said shank is of substantially rectangular shape.

4. A needle assembly as claimed in claim 3 wherein said plate is of substantially rectangular shape.

5. A needle assembly as claimed in claim 1 wherein said groove extends substantially along two-thirds of the length of said shank.

6. A needle assembly as claimed in claim 1 wherein said means on the shank for cooperating with the cams comprises a projection on said shank beyond said groove.

7. A needle assembly as claimed in claim 1 wherein said lug extends laterally beyond the shank for cooperating with the external cams for extending and retracting the plate.

8. A needle assembly as claimed in claim 1 wherein said shank includes a U-shaped portion with said longitudinal groove therein, said stop members being affixed in said U-shaped portion to close the mouth of the groove.

9. A needle assembly as claimed in claim 1 wherein said plate has an end portion with a pointed head and blunt end for cooperating with said hook.

10. A needle assembly as claimed in claim 1 wherein said stop members extend lengthwise along the groove and guide said plate in its slidable movement in said groove.

* * * * *